US005211716A

United States Patent [19]

Tobias

[11] Patent Number: 5,211,716

[45] Date of Patent: May 18, 1993

[54] EXPANDABLE VALISE WITH VERTICAL STABILIZING STRAPS

[76] Inventor: Charles S. Tobias, Road Town, Tortola, British Virgin Islands

[21] Appl. No.: 841,167

[22] Filed: Feb. 25, 1992

[51] Int. Cl.[5] ..... A45C 7/00

[52] U.S. Cl. ..... 190/103; 190/107; 190/27; 190/116; 190/127; 150/108; 383/2

[58] Field of Search ..... 190/103-105, 190/21, 22, 14, 15, 107, 124, 900, 902, 127; 383/2

[56] References Cited

U.S. PATENT DOCUMENTS

| | | | |
|---|---|---|---|
| D. 315,987 | 4/1991 | Tobias | D3/77 |
| 179,745 | 7/1876 | Blake | 190/103 |
| 367,403 | 8/1887 | Jenks | 190/103 |
| 1,200,344 | 10/1916 | Hanan | 190/103 |
| 1,329,574 | 2/1920 | Axelman et al. | 190/902 X |
| 1,385,384 | 7/1921 | Mashek | 190/103 X |
| 1,437,565 | 12/1922 | Stein et al. | 190/103 |
| 1,553,832 | 9/1925 | Mosher | 190/902 X |
| 1,636,838 | 7/1927 | Roser | 383/2 X |
| 1,638,753 | 8/1927 | Stein et al. | 190/902 X |
| 1,641,871 | 9/1927 | Solomon | 190/902 X |
| 1,702,905 | 2/1929 | Korchmar | 190/902 X |
| 1,731,547 | 10/1929 | Stansbury | 190/902 X |
| 2,159,995 | 5/1939 | Lifton | 190/127 |
| 2,334,895 | 11/1943 | Bracken | 190/111 |
| 4,148,347 | 4/1979 | Seaman | 383/2 |
| 4,919,240 | 4/1990 | Tobias | 190/103 |

FOREIGN PATENT DOCUMENTS

| | | | |
|---|---|---|---|
| 163921 | 11/1954 | Australia | 190/104 |
| 20989 | 2/1883 | Fed. Rep. of Germany | 190/103 |
| 3423978 | 1/1985 | Fed. Rep. of Germany | 190/900 |
| 405386 | 12/1909 | France | 190/124 |
| 27576 | of 1909 | United Kingdom | 150/108 |

*Primary Examiner*—Sue A. Weaver
*Attorney, Agent, or Firm*—David H. Semmes

[57] ABSTRACT

Handbags, particularly an expandable valise having an expandable body portion so as to accommodate variously sized contents. The valise includes the combination of a rigid batten adjustably supported on its top and pairs of inner and outer adjusting-reinforcing straps which encircle the entire valise, as well as the batten so as to contain or stabilize the body portion and its contents.

8 Claims, 4 Drawing Sheets

EXPANDABLE VALISE WITH VERTICAL STABILIZING STRAPS

CROSS-REFERENCES TO RELATED APPLICATIONS

An improvement upon applicant's EXPANDABLE VALISE, as disclosed in U.S. Pat. No. Des. 315,897 and U.S. Pat. No. 4,919,240. In U.S. Pat. No. 4,919,240, an horizontal encircling strap is positioned around the lower body portion of the valise, so as to contain expansion and contraction of the body portion. In the present application, the expansion and contraction of the body portion is contained or stabilized by the combination of an adjustable batten and pairs of inner and outer adjusting straps.

BACKGROUND OF THE INVENTION

1. Field of the Invention

This invention relates to portable and collapsible valises wherein an expandable configuration may be adjustably conformed to varying content volume and stabilized against distortion as in traveling. Stability is achieved by the combination of an adjustable batten, and pairs of inner and outer adjusting straps which vertically encircle the entire body portion of the valise. In the preferred configuration, a pair of inner vertical reinforcing straps extends rear to front around the bottom of the valise. In addition, a pair of outer vertical reinforcing straps which are disposed in parallel and abutting relation relative to the pair of inner straps, extends fully around the valise body portion and, also, secures the top by extending through a substantially rigid, yet adjustable batten. Whereas numerous valise and pouch containers have been devised with reinforcing straps engaging the exterior thereof, no such combination of adjustable batten and pairs of inner and outer reinforcing adjusting straps has been devised to stabilize an expandable valise, irrespective of its variously sized contents.

2. Prior Art

STEIN—U.S. Pat. No. 1,638,753
STANSBURY—U.S. Pat. No. 1,931,547
SEAMAN—U.S. Pat. No. 4,148,347
BLAKE—U.S. Pat. No. 179,945
Germany (WERBE)—20989 (1983)
Great Britain (ORTWEILER)—27567 (1908)

SUMMARY OF THE INVENTION

The present invention concerns an expandable and collapsible valise rigidized and supported against distortion by a pair of first inner vertical adjustment reinforcing straps and a pair of second outer vertical adjusting reinforcing straps. The pair of outer vertical adjusting-reinforcing straps is retained in situ by means of a rigid top batten having retention keepers thereon. The free ends of the pair of inner adjusting-reinforcing straps are adjustable fixed to studs affixed to the lower portion of the front panel of the valise. The pair of outer vertical adjusting reinforcing straps is adjustably secured by each free strap end engaging a buckle end.

BRIEF DESCRIPTION OF THE DRAWINGS

In FIG. 1, the expandable contractible valise is illustrated as including collapsible body portion 10 comprised of front panel 12 and enclosable top panel 14. In FIGS. 3 and 5, the valise body portion 10 is illustrated as including side panels 16, 18, rear panel 20, having rear pocket 34 and bottom panel 22.

Figure 1:
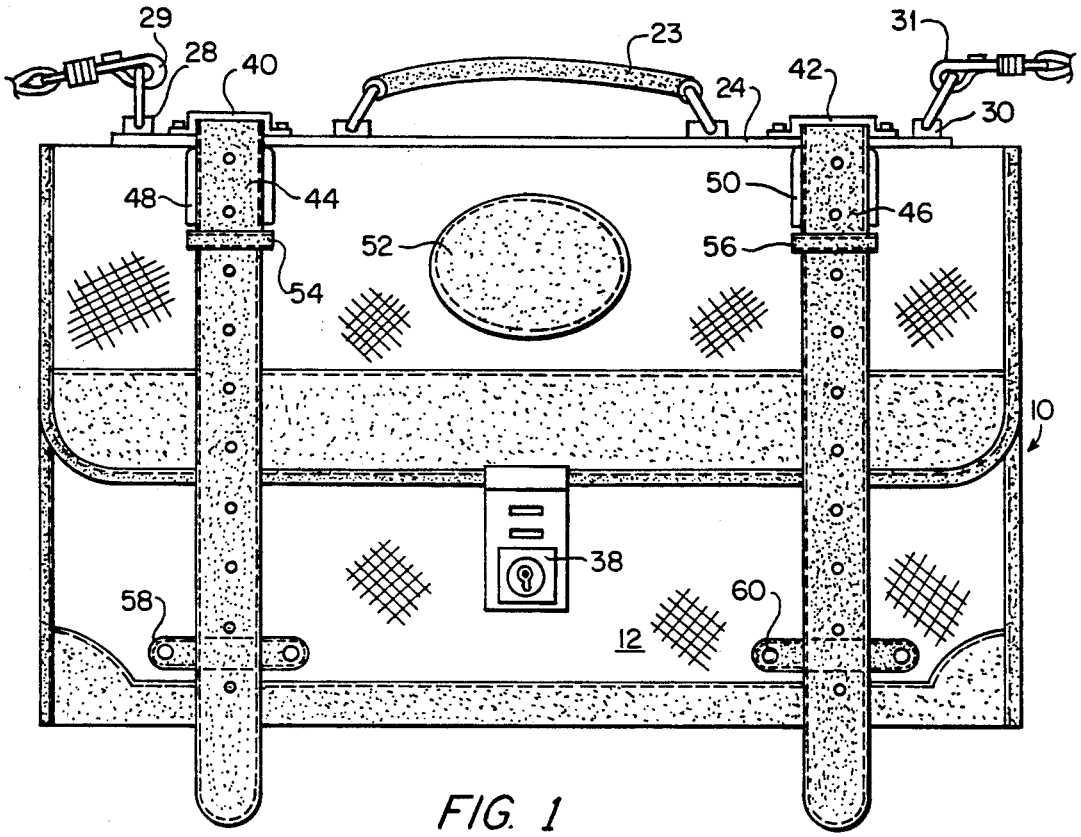
FIG. 1 is a front elevation of the expandable valise, showing the pair of outer vertical adjusting-reinforcing straps secured by engagement of each strap buckle with the adjusting holes in each free end.

An adjustable, rigid batten 24, having carrying handle 23, is illustrated in FIG. 1 as including shoulder strap anchors 28, 30 for engagement with shoulder strap 26 snap clips 29, 31.

Figure 3:
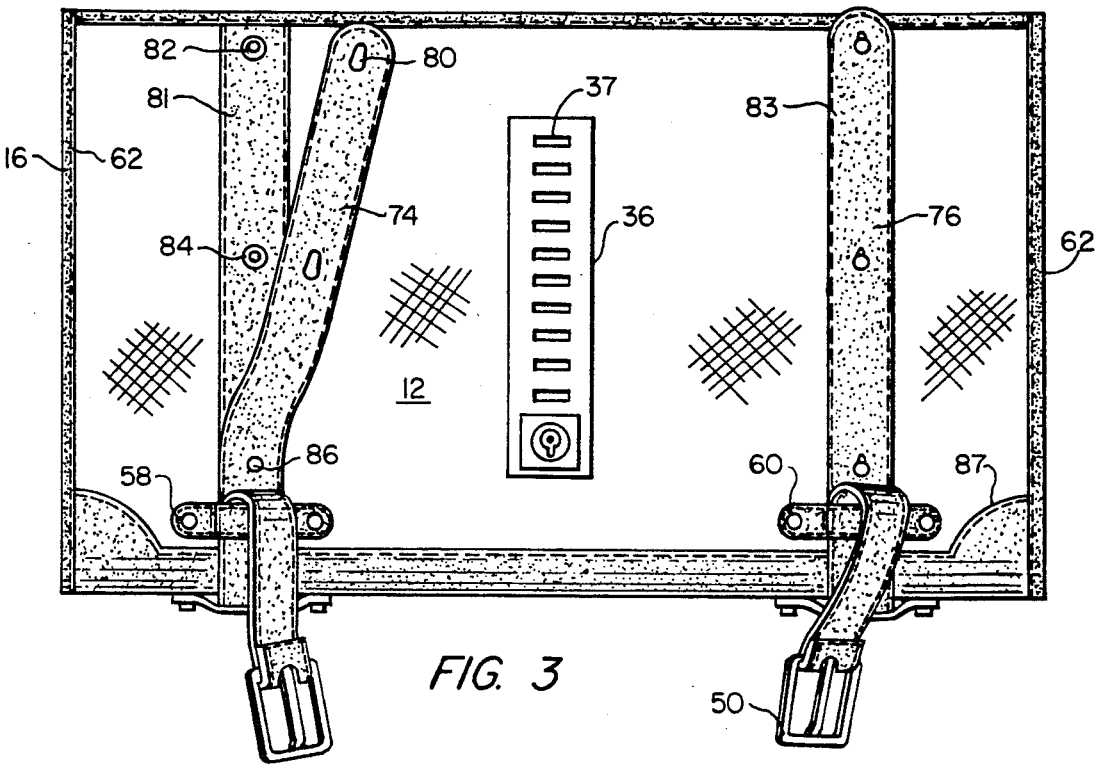
FIG. 3 is a front elevation of the front panel, showing the adjustable lock means and the free ends of the inner vertical straps engaging the adjustable studs positioned on the front panel.

In FIG. 3, adjustable lock member 36 is illustrated as having individual locking aperture 37 for engagement with top panel locking hasp 38.

A pair of vertically extending stud straps 81, 83 are stitched into front panel 12, so as to support aligned adjusting studs 82, 84, 86 which engage corresponding holes 80 in the free ends of the pair of inner adjusting straps. The other or anchor ends of inner adjusting straps 74, 76 are stitched to back panel 20-in-between the top of pocket 34 and bottom leather reinforcement 87. As will be apparent in FIG. 2, a pair of guard straps 90, 92 may be secured by stitching to top panel 14 so as to abut adjusting-reinforcing outer straps 44, 46. Each outer strap has adjusting holes 88 at its free top end and a buckle 48, 50 at its bottom end. Straps 44, 46 may be guided in encircling the entire valise body portion by means of keepers 40, 42 on rigid batten 24, keepers 94, 96 on rear panel 20, keepers 70, 72 on bottom panel 22 and keepers 58, 60 on front panel 12.

Figure 2:
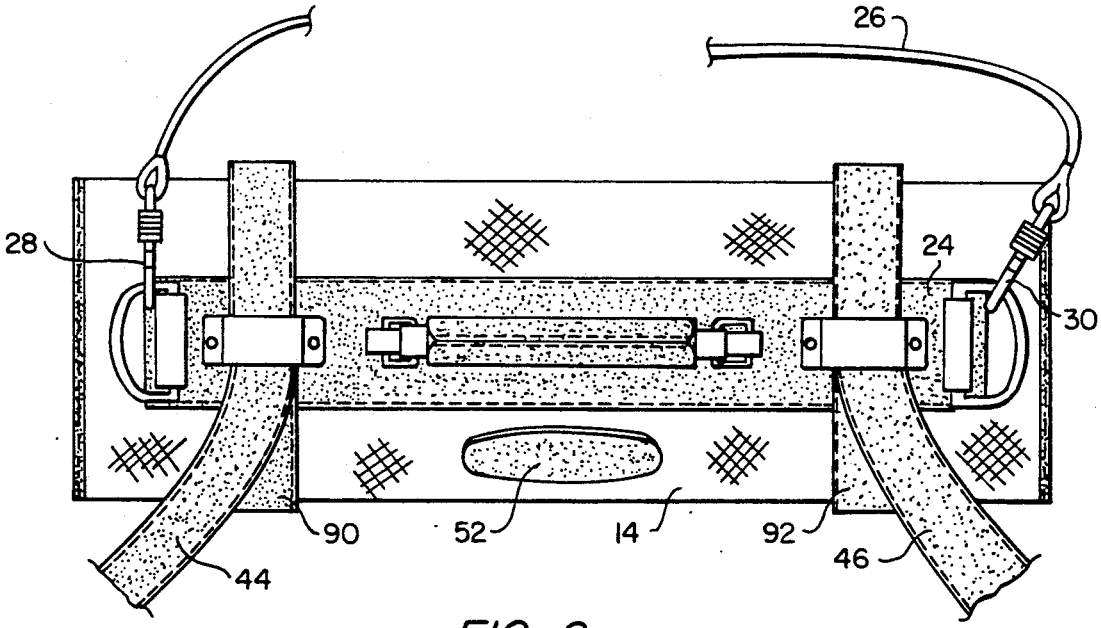
FIG. 2 is a top plan showing the top panel with adjustable batten securing the free ends of the outer vertical straps.

A trademark emblem 52, or the like, may be secured to top panel 14, as illustrated in FIG. 2.

Figure 6:
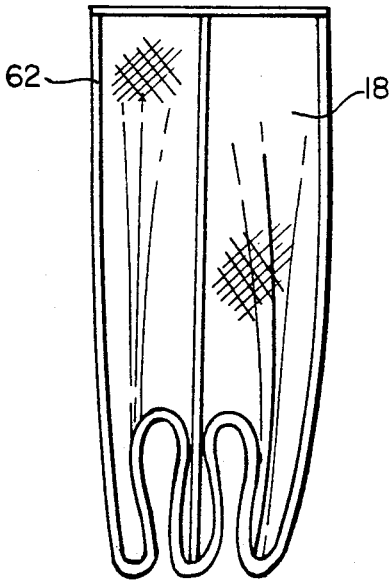
FIG. 6 is an end elevation of the collapsed body portion.
Figure 7:
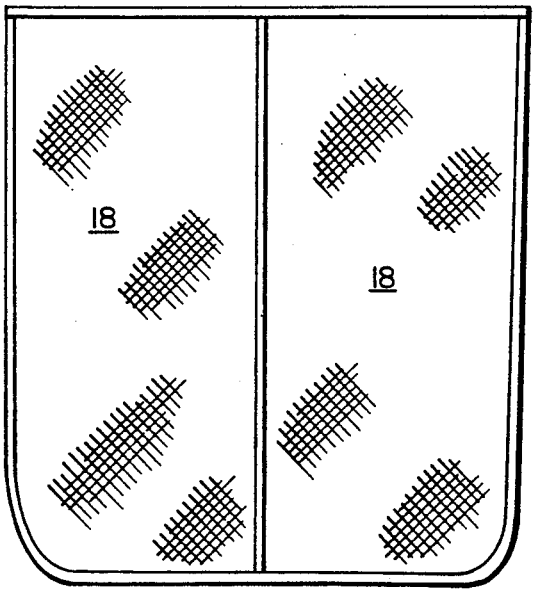
FIG. 7 is an end elevation of the expanded body portion.
Figure 8:
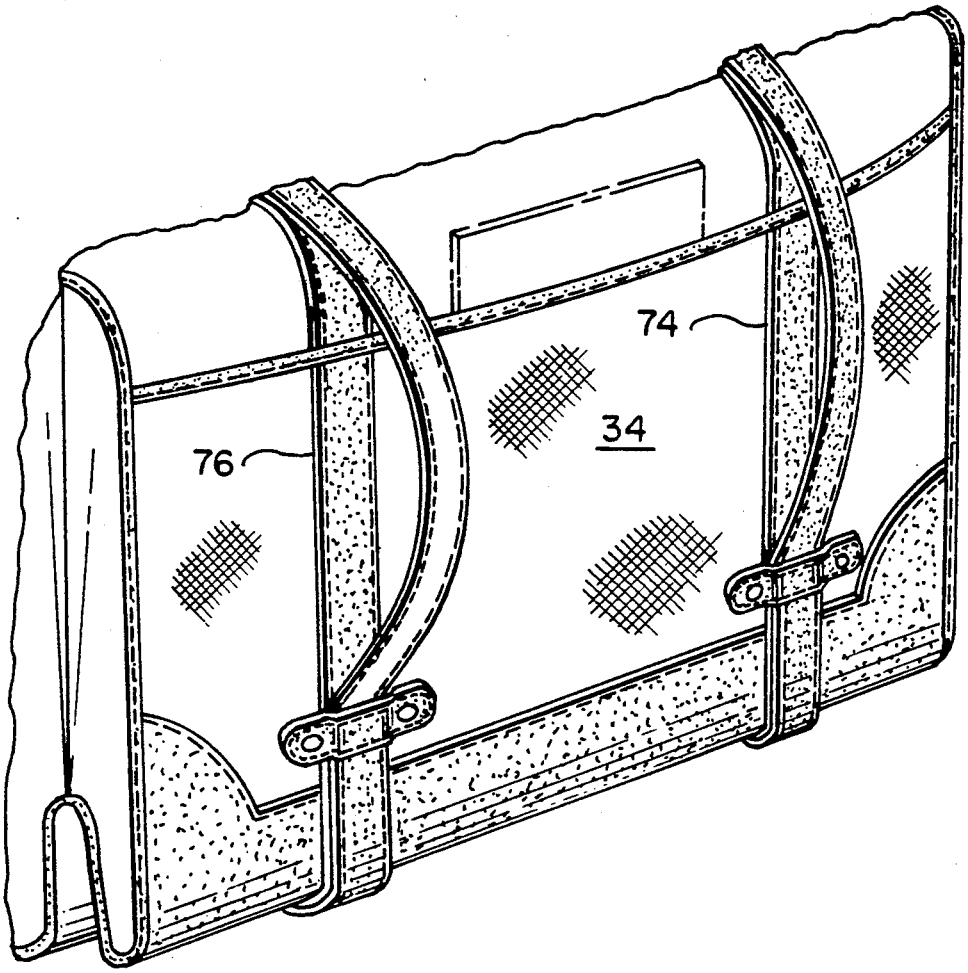
FIG. 8 is a fragmentary rear perspective.

The front, rear and bottom panels 12, 20 and 22 may include peripheral leather reinforcing bead 62, as illustrated in FIG. 6.

Figure 4:
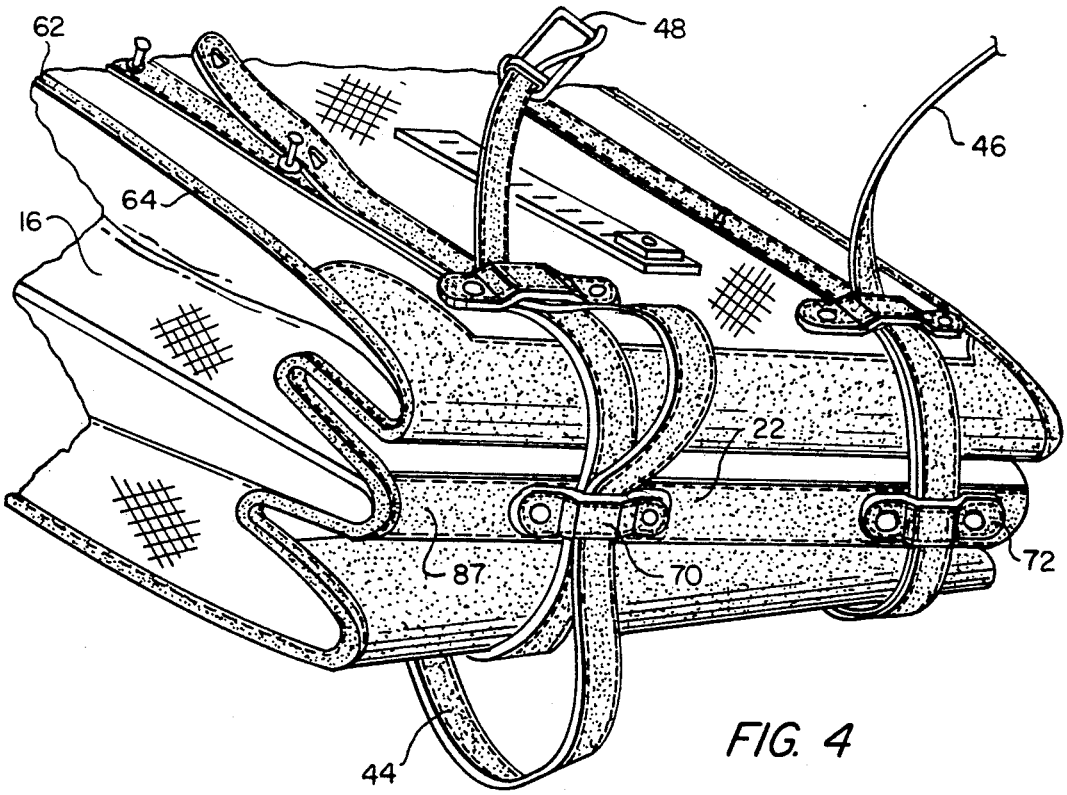
FIG. 4 is a bottom plan, showing the pair of inner vertical adjusting-reinforcing straps and the pair of outer vertical adjusting-reinforcing straps secured by pairs of keepers at the lower portion of the rear panel, on the bottom panel and on the lower portion of the front panel.
Figure 5:
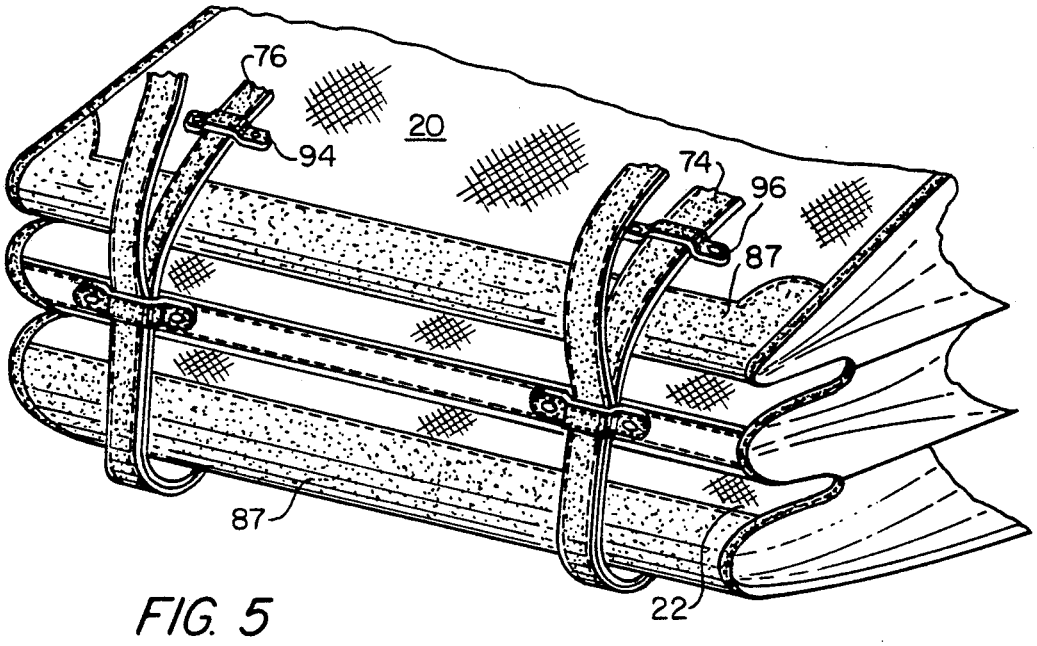
FIG. 5 is rear elevation of the back panel showing the outer pocket and the pairs of inner and outer adjusting-reinforcing straps encircling the valise.

As body portion 10 is expanded, as illustrated in FIGS. 4 and 5, inner vertical straps 74, 76 may be secured via holes 80 to adjusting studs 82, 84, 86 on front panel 12. As illustrated in FIG. 1, top enclosable panel 14 may then be secured by hasp 38 engaging adjusting apertures 37 within lock 36 and the entire expanded body portion 10 may be secured by outer vertical strap free ends 44, 46 with adjusting holes 88 engaging buckles 48, 50 and keepers 54, 56. As a result, the valise may be expanded and stabilized to conform to the variously sized loads that body portion 10 contains. Since batten 42 is adjustably secured to the outer adjusting straps 44, 46 batten 24 may be centered on top panel 14, so as to compensate for the expansion or contraction of body portion 10. The adjustment capability of inner straps 74, 76 provides a rigidized support of the expanded load via adjusting studs 82, 84, 86,. This securement is enhanced by outer adjusting straps 44, 46 and the centering of adjustable batten 24. Manifestly, variations in conformation of the inner and outer adjusting-reinforcing straps, as well as the adjustable batten, may be employed without departing from the spirit and scope of invention.

I claim:

1. An expandable valise of the type having inner partitions for carrying business papers, comprising:

a) a compressible-expandable body portion including enclosable top, front, rear and side panels and an extensible-contractable bottom panel having flexible convolutions extending between said side panels;

b) a rigid batten, centered adjustably upon said top panel, said rigid batten supporting top strap keepers adjacent opposed ends of the batten;

c) pairs of adjusting straps, vertically encircling the valise, further including:

i) a pair of first inner vertical straps, each strap having a bottom portion secured at one end upon said rear panel and extending around said extensible-contractable bottom panel and having a free end with adjusting holes for adjustable securement to said front panel; each said inner strap including a top portion extending from said rear panel over said enclosable top panel;

ii) a pair of second outer straps, each strap being adjustably secured to said batten by said top strap keepers and adjustably secured to said rear panel, bottom panel and front panel by rear panel keepers, bottom panel keepers and front panel keepers affixed, respectively, thereon; said second outer straps each including a free end having adjusting holes extending over the enclosable top panel and a buckle end extending over the lower portion of said front panel for engagement with the adjusting holes in said free end; and d) adjusting studs protruding from each side of the lower portion of said front panel, so as to complementally engage and secure said adjusting holes of each said first inner strap free end.

2. An expendable valise as in claim 1, including a shoulder strap secured at either end to said rigid batten by means of shoulder strap anchors supported upon said batten.

3. An expandable valise as in claim 1, said rigid batten further including a carrying handle positioned thereon.

4. An expandable valise as in claim 3, said bottom panel having reinforcing means secured to its transverse mid-portion, so as to support said bottom panel keepers and engage said pair of inner straps.

5. An expandable valise as in claim 4, including adjustable lock means secured to said front panel so as to engage a corresponding hasp secured to said enclosable top panel.

6. An expandable valise as in claim 5, including a rear outer pocket defined in said rear panel.

7. An expandable valise as in claim 6, wherein said top portion of said inner straps form a pair of guard straps, each guard strap being secured upon said enclosable top panel and extending from the top of said rear outer pocket to a free end of said enclosable top panel so as to abut said pair of outer straps.

8. An expandable valise as in claim 7, each said inner strap bottom portion being secured at one end upon said rear outer pocket in alignment with one of said guard straps.

* * * * *